US005236087A

United States Patent [19]

Morgan

[11] Patent Number: 5,236,087

[45] Date of Patent: Aug. 17, 1993

[54] FERROUS METAL COIL EDGE AND LAP PROTECTOR

[76] Inventor: Royston P. Morgan, 17248 Carolina, Chelsea, Mich. 48118

[21] Appl. No.: 894,725

[22] Filed: Jun. 4, 1992

Related U.S. Application Data

[63] Continuation of Ser. No. 769,959, Oct. 1, 1991, abandoned.

[51] Int. Cl.[5] ..... B65D 85/66

[52] U.S. Cl. ..... 206/397; 206/818

[58] Field of Search ..... 206/397, 398, 401, 818

[56] References Cited

U.S. PATENT DOCUMENTS

| | | | |
|---|---|---|---|
| 3,453,695 | 7/1969 | Owen | 206/397 |
| 3,670,877 | 6/1972 | Reed | 206/397 |
| 4,204,479 | 5/1980 | Rosa | 206/397 |

OTHER PUBLICATIONS

Outline History.
Letter to LTV, Mar. 30, 1987.
Invoice to USX, Oct. 26, 1990.
Purchase Order from USX, Jun. 14, 1990.
Invoice to USX, Jan. 29, 1991.
Letter to LTV, Aug. 11, 1987.
Memorandum of LTV Activity Apr. 17, 1987.
Letter to LTV, Jun. 27, 1991.
Purchase order from LTV, Jul. 13, 1990.
Invoice to LTV, Oct. 22, 1990.
Invoice to LTV, Jan. 1, 1991.
Memorandum to LTV, Jun. 1, 1991.

*Primary Examiner*—William I. Price
*Attorney, Agent, or Firm*—Peter D. Keefe

[57] ABSTRACT

A protector for ferrous metal sheet coils which protects the edge and exposed lap areas thereof from being damaged during manipulation and transportation. A first aspect of the invention is an outer lap protector composed of an outer lap cover portion curved to coincide with the curvature of the outer lap of the coil and an outer edge cover portion integrally connected with the outer lap cover portion and oriented at right angles thereto. A magnet is connected to the outer lap cover portion for magnetically attaching the outer lap protector to the outer lap of the coil. A second aspect of the invention is an inner lap protector composed of an inner lap cover portion curved to coincide with the curvature of the inner lap of the coil and an inner edge cover portion integrally connected with the inner lap cover portion and oriented at right angles thereto. A magnet is connected to the inner lap cover portion for magnetically attaching the inner lap protector to the inner lap of the coil. A preferred material for the structural components of the outer and inner lap protectors is a high impact plastic, and the preferred magnet is of the flexible sheet type.

17 Claims, 3 Drawing Sheets

FERROUS METAL COIL EDGE AND LAP PROTECTOR

This application is a continuation of copending application Ser. No. 07/769,959, filed Oct. 1, 1991, now abandoned.

BACKGROUND OF THE INVENTION

1. Field of the Invention

The present invention relates to devices used in connection with coils of metal sheet stock, and more particularly to edge protectors to aid prevention of edge and lap damage to ferrous metal coils during manipulation and transportation thereof.

2. Description of the Prior Art

Elongate ferrous metal sheet, particularly sheeting of steel and stainless steel, are conveniently rolled into a coil for purposes of compactness and facilitation of transportation. These coils have a "donut" appearance, in that the sheeting is wound having an inside diameter periphery or "core" defined by an inner lap of the coil and an outside diameter periphery defined by an outer lap of the coil.

These coils typically have an outside diameter on the order of about 3 to 7 feet, and consequently are very heavy. Manipulation of these coils is accomplished by material handling equipment, such as a forklift or an overhead crane. A forklift is equipped with a ram connected to a raisable carriage, wherein the ram is positioned by the operator so as to contact the inner lap so that the coil may be raised and thereupon moved. Typically, a crane utilizes a C-hook or a pair of grabs. In the case of the latter, the grabs descend toward the coil (see FIG. 2), strike the outer lap, scrape along the edges of the laps, reach the core, whereupon they move mutually toward one another so as to grab the coil at the inner lap. Accordingly, it will be understood that frequently the outer lap, the inner lap and the lap edges can be damaged during manipulation of the coil by the material handling equipment. During transportation, the outer lap and inner lap are subjected to potential damage due to denting and abrasion at all points of contact with support members, including chains and other types of anchorage devices, as well as abrasion caused by contact with adjacent coils.

The portions of the coil that are damaged during manipulation and transportation are frequently wasted, or, alternatively, require costly repair. Accordingly, what is needed in the art is a simple, easily attached protector of ferrous metal sheet coils.

SUMMARY OF THE INVENTION

The present invention is a protector for ferrous metal sheet coils which serves to prevent edge and lap damage thereto during manipulation and transportation thereof.

In a first aspect of the present invention, an outer lap protector is provided which has generally "L" shape, composed of an outer lap cover portion curved to coincide with the curvature of the outer lap of the coil and an outer edge cover portion integrally connected with the outer lap cover portion at right angles thereto. The outer lap cover portion has a magnet attached thereto which serves to magnetically attract the coil, thereby attaching the outer lap protector to the outer lap of the coil. It is preferred for the outer edge cover portion to include displaced panel portions so as to accommodate lap edge irregularities in coil winding and to absorb the shock of an untoward impact with material handling equipment. It is further preferred to provide flexibility of movement of the outer lap cover portion with respect to the outer edge cover portion, and further to provide articulation of segments of the outer edge cover portion so as to accommodate coils of various outside diameters.

In a second aspect of the present invention, an inner lap protector is provided which has a generally "L" shape, composed of an inner lap cover portion curved to coincide with the curvature of the inner lap of the coil and an inner edge cover portion integrally connected with the inner lap cover portion at right angles thereto. The inner lap cover portion has a magnet attached thereto which serves to magnetically attract the coil, thereby attaching the inner lap protector to the inner lap of the coil. It is preferred for the inner edge cover portion to include displaced panel portions so as to absorb the shock of an untoward impact with material handling equipment. It is further preferred to provide flexibility of movement of the inner lap cover portion with respect to the inner edge cover portion, and further to provide articulation of segments of the inner edge cover portion so as to accommodate coils of various inside diameters.

Accordingly, it is an object of the present invention to provide a protector of the outer lap and adjacent lap edges of a coil of ferrous sheet metal stock.

It is another object of the present invention to provide a protector of the inner lap and adjacent lap edges of a coil of ferrous sheet metal stock.

It is a further object of the present invention to provide a protector of the outer lap and adjacent lap edges of a coil of ferrous sheet metal stock, in which the protector is releasably connected with the outer lap via a magnetic material.

It is an additional object of the present invention to provide a protector of the inner lap and adjacent lap edges of a coil of ferrous sheet metal stock, in which the protector is releasably connected with the inner lap via a magnetic material.

It is still another object of the present invention to provide a protector of the outer lap and adjacent lap edges of a coil of ferrous sheet metal stock, in which the protector is releasably connected with the outer lap via a magnetic material wherein the protector is adjustable to accommodate coils of various outside diameters.

It is yet an additional object of the present invention to provide a protector of the inner lap and adjacent lap edges of a coil of ferrous sheet metal stock, in which the protector is releasably connected with the inner lap via a magnetic material wherein the protector is adjustable to accommodate coils of various inside diameters.

These, and additional objects, advantages, features and benefits of the present invention will become apparent from the following specification.

DETAILED DESCRIPTION OF THE PREFERRED EMBODIMENTS

Figure 1:
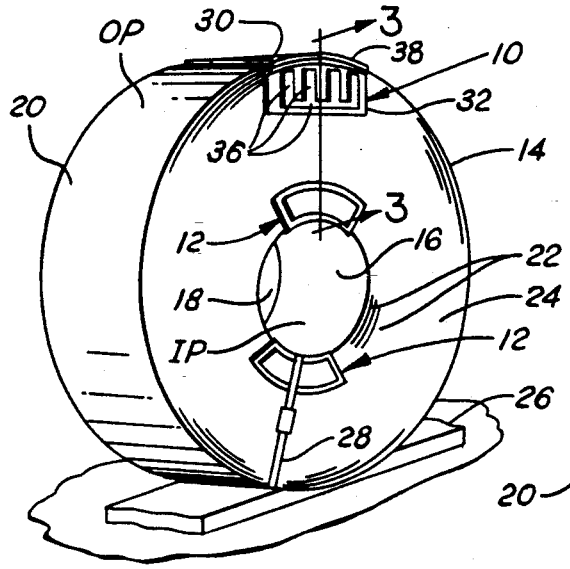
FIG. 1 is a perspective view of an outer lap protector according to the present invention and an inner lap protector according to the present invention, both shown in operation with respect to a coil of ferrous metal sheet stock.
Figure 2:
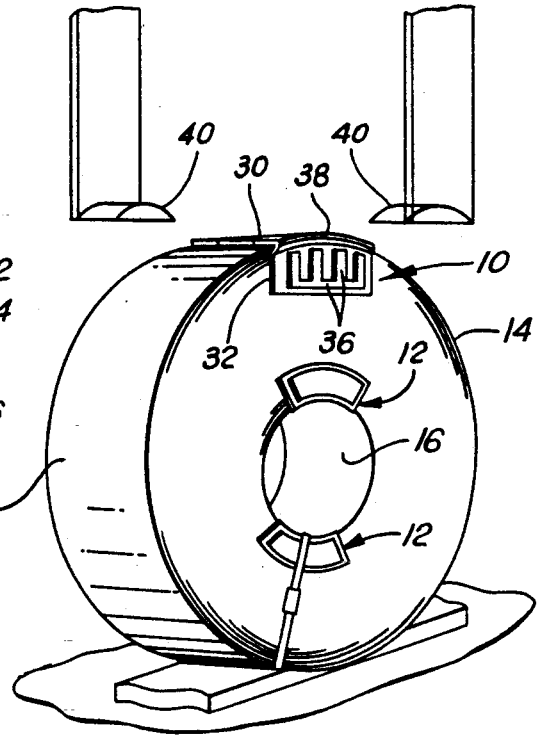
FIG. 2 is a perspective view as in FIG. 1, now showing an operational environment in which a material handling device is about to engage the coil.
Figure 3:
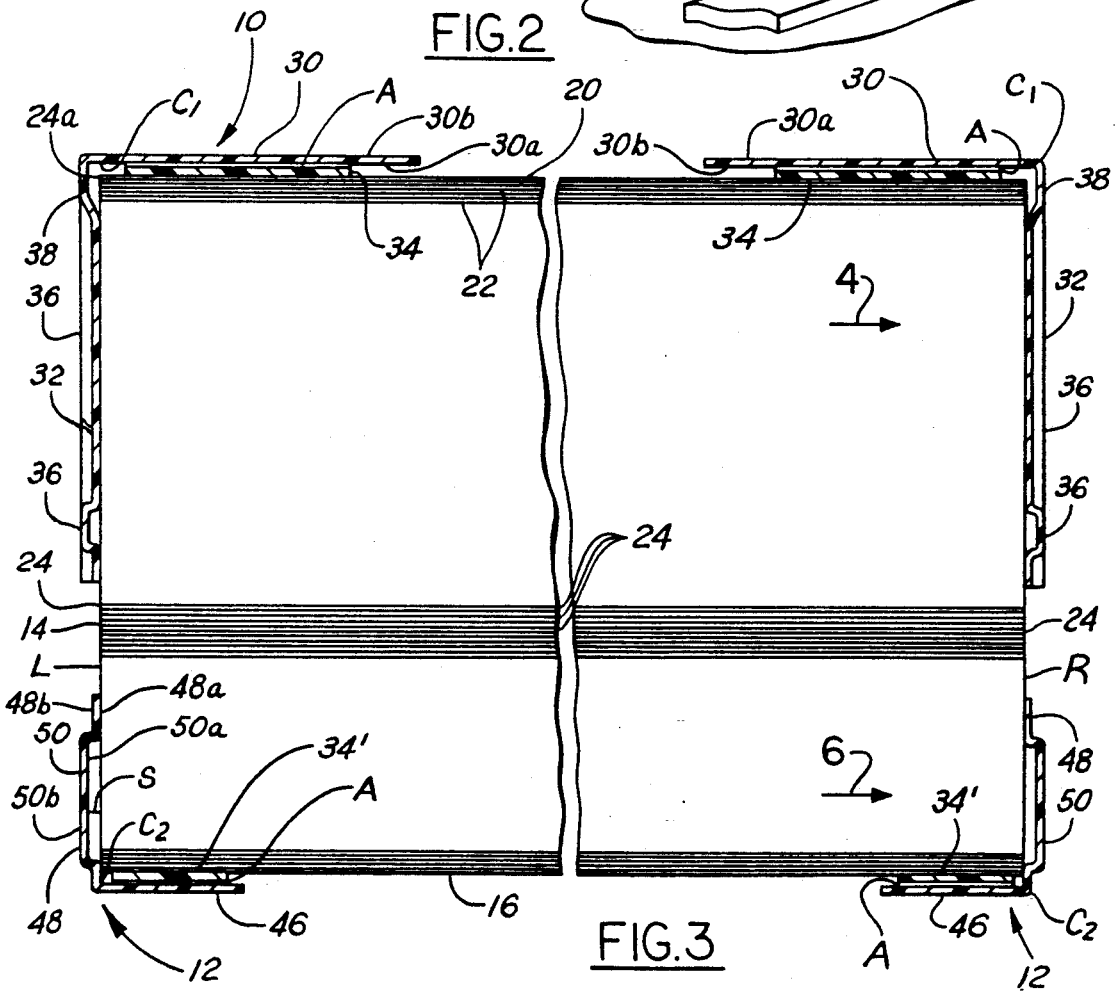
FIG. 3 is a partly sectional end view of the outer and inner lap protectors seen along lines 3—3 in FIG. 1.

Referring now to the Drawing, FIG. 1 generally shows the outer lap protector 10 according to the present invention and the inner lap protector 12 according to the present invention, each being shown in operation with respect to a ferrous metal sheet coil 14. The coil 14 is composed of a single, elongate sheet of ferrous metal, such as steel, which has been wound. The winding results in an inner lap 16 which defines an inside periphery IP characterized by the coil core 18, and further results in an outer lap 20 which defines an outside periphery OP. Each lap 22 has and edge 24 on the left side L and on the right side R of the coil 14. The coil is shown resting upon a pallet 26, and shown held firmly in its wound configuration by a tie-strap 28. Typically, but not necessarily, the coil 14 has an outside diameter on the order of three to seven feet, and an inside diameter on the order of sixteen to twenty-four inches. Ordinarily, the coil 14 is quite heavy, requiring manipulation by mechanized material handling equipment, such as a crane or forklift. The outer lap protector 10 and the inner lap protector 12 are releasably mounted by magnets to the coil 14 so as to protect the outer and inner laps 20, 16, as well as lap edges 24 adjacent thereto from potential damage due to material handling equipment and further from damage during transportation. An estimated 0.5 to 1.5 percent average reduction in damaged ferrous sheet metal product can be expected from use of the outer lap protector 10 and inner lap protector 12.

Referring now to FIGS. 1 through 5, the structure and function of the outer lap protector 10 will be detailed.

The outer lap protector 10 has a generally "L" shape, composed of an outer lap cover portion 30 curved to coincide with the curvature of the outer periphery OP of the coil 14 which is defined by the outer lap 20, and further composed of an outer edge cover portion 32 which is integrally connected with the outer lap cover portion 30 at a curved right angle corner $C_1$ with respect thereto. The outer lap cover portion is preferred to be curved to match the curvature of the outer periphery of an average size coil, a coil of about four feet in outside diameter; in this case the outer lap protector 10 can accommodate coils of various outside diameters both larger and smaller than this average outside diameter. The outer lap cover portion is further preferred to be made of a high impact plastic, a high density polyethylene being preferred for economic reasons; other materials, such as rubber, fiberglass and the like are also suitable for use. The outer lap protector 10 is formed as a single piece unit by processes well known in the art of plastics manufacture, such as roto molding, vacuum forming, injection molding or extrusion.

The outer lap cover portion 30 has an inside surface 30*a* which faces toward the coil 14 and an outside surface 30*b* which faces away from the coil. A magnet 34 is attached to the inside surface 30*a* of the outer lap cover portion 30. The magnet 34 serves to magnetically attract the ferromagnetic material of the coil 14, thereby holding the outer lap protector 10 onto the outer lap 20 in a selectively releasable manner. The magnet 34 is preferred to be of the flexible, thin (on the order of, but not necessarily, 0.006 to 0.125 inches thick) sheet type commonly known in the magnetics art, and to extend over a substantial portion of the area of the inside surface 30*a* of the outer lap cover portion 30. The magnet 34 is attached to the inside surface 30*a* of the outer lap cover portion 30 in a permanent manner that is unaffected by oil preferably by an adhesive A, such as high tack acrylic adhesive made by Minnesota Mining and Manufacturing Co., of St. Paul, Minn., for example Type A60. The magnet 34 can be applied in a single piece or in multiple pieces on the inside surface 30*a*. Magnets 34 are selected on a case by case basis for best durability and magnetic performance (typical magnetic strengths thereof ranging from around 0.7 to around 7.0 MGOe). The outer lap cover portion 30 is curved so that the inside surface 30*a* and the magnet 34 both follow the contour of the outside periphery OP defined by the outer lap 20.

The outer edge cover portion 32 is integrally connected at a curved right angle corner $C_1$ with the outer lap cover portion 30. The outer edge cover portion 32 extends radially toward the core 18 from the curved corner $C_1$ so as to cover a number of lap edges 24 adjacent to the outer lap edge 24*a*. The outer edge cover portion 32 has an inside surface 32*a* facing toward the coil 14 and an outside surface 32*b* facing away from the coil. It is preferred to provide the outer edge cover portion 32 with a plurality of displaced panel portions 36. The displaced panel portions 36 are preferred, but not required, to be in the form of elongate panels having an inside surface 32*a*' displaced from the inside surface 32*a* and outside surface 32*b*' displaced from the outside surface 32*b* so as to provide a spacing S for deformation that accommodates squeezing without injury to the coil 14 during manipulation and transportation of the coil, as well as stiffening for retention of shape of the outer edge cover portion. It is further preferred to provide an outer lap edge displaced panel portion 38 which is in the form of an elongate panel displaced from the inside surface 32*a* adjacent curved corner $C_1$ so as to provide for accommodation of deformation and for strength, as in the displaced panel portions 36, and further so as to accommodate irregularities in lap alignment adjacent the edge 24*a* of the outer lap 20.

The outer lap protector 10 is dimensioned as necessary per a particular environment of use to adequately protect the outer lap edge 24*a* and lap edges 24 adjacent thereto as well as a portion of the outer lap 20 adjacent the outer lap edge. For instance, in the operational environment shown in FIG. 2, a crane is about to drop a pair of grabs 40 onto the coil 14. As the grabs descend, they strike the outer lap cover portion 30, the outer lap edge displaced panel portion 38 and the displaced panel portion 36. During this encounter, the outer lap protector 10 has prevented injury from happening to the coil 14. As an example, the coil 14 is 6 feet in outside diameter, the outer lap cover portion 30 and the outer edge cover portion 32 are dimensioned to extend from about eighteen to thirty-six inches measured along the curved corner $C_1$, the outer lap cover portion 30 is dimensioned to extend across the outer lap 20 about four to twelve inches measured from the curved corner $C_1$, the magnet 34 is dimensioned a little smaller than the area of the outer lap cover portion 30, and the outer edge cover portion 32 is dimensioned to extend about nine to fifteen inches measured from the curved corner $C_1$.

In operation, the user simply places the outer lap protector onto the coil adjacent the outer lap edge at a location on the periphery where damage is possible, such as where a material handling device may strike the coil, or where coils may mutually rub against each other during transportation. The magnet automatically attaches the outer lap protector to the coil, and the user may easily remove it by simply lifting the magnet away from the surface of the outer lap.

Depending on the environment of use of the outer lap protector 10, the portion of the outside periphery OP of the coil 14 that needs protection may vary. Accordingly, the length of the outer lap protector 10 as measured along the curved corner $C_1$ may be as long as required, extending, for instance, from 10 to 190 degrees or more.

Figure 4:
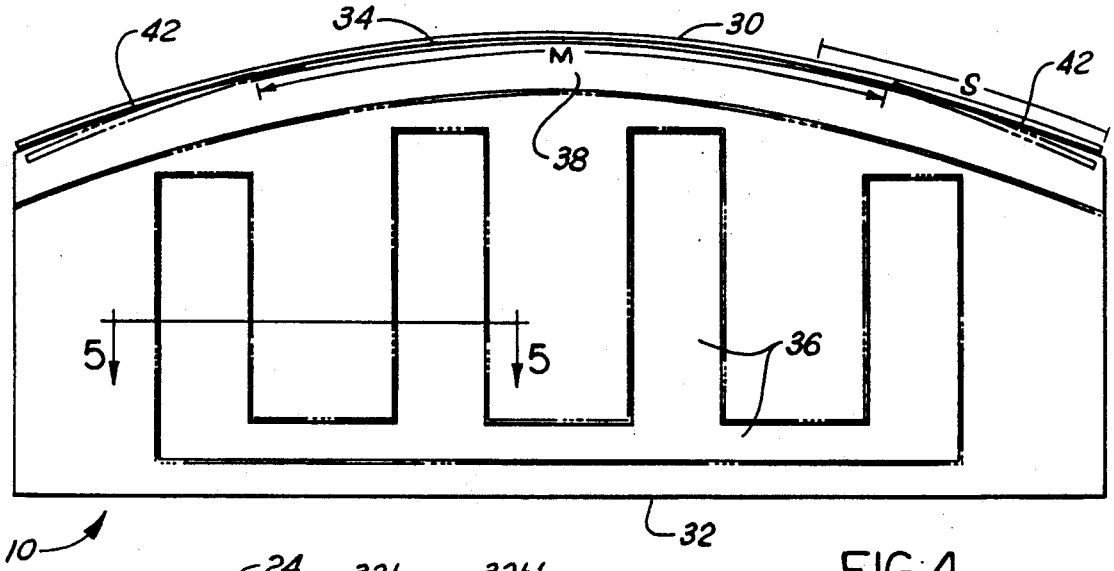
FIG. 4 is a partly sectional side view of the outer lap protector, seen along arrow 4 in FIG. 3.
Figure 5:
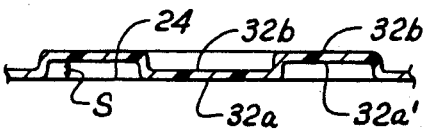
FIG. 5 is a partly sectional plan view of the outer lap protector, seen along lines 5—5 in FIG. 4.
Figure 6:
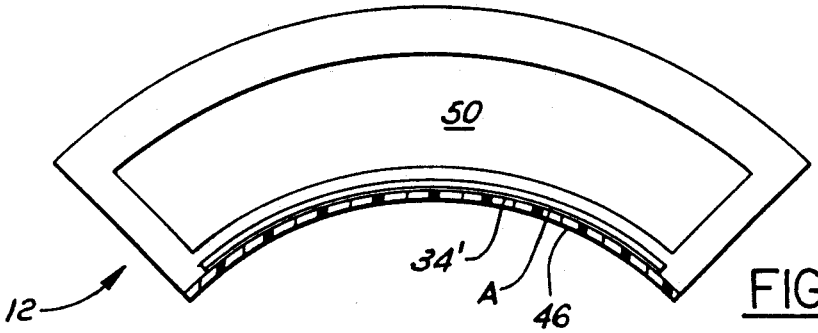
FIG. 6 is a partly sectional side view of the inner lap protector, seen along arrow 6 in FIG. 3.
Figure 7:
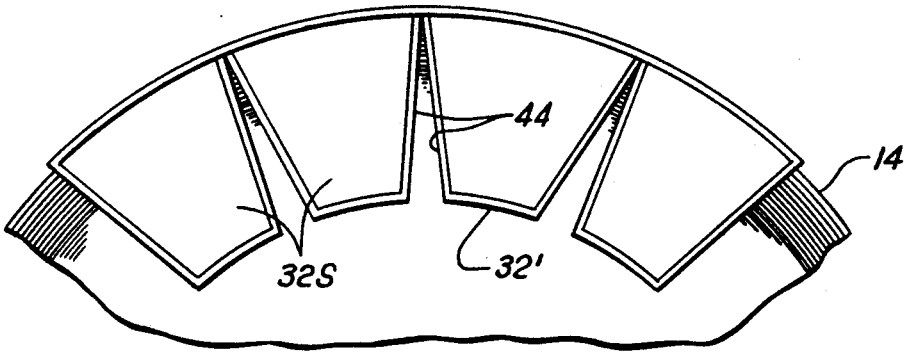
FIG. 7 is a side view of a segmentally articulated outer lap protector for accommodating coils of various outside diameters.

As can be understood from reference being had to FIG. 4, in the event the outer lap protector 10 is to accommodate coils having various outside diameters, it is preferred to provide a relief slit 42 along a portion S of each end of the curved corner $C_1$. The relief slits 42 allow for the outer lap cover portion 30 to bend adjustably to the radius of curvature of the outer periphery as defined by the outer lap. In this construction, the magnet 34 is preferred, but not required, to be located in the region M between the relief slits 42. In this regard further, FIG. 7 shows an outer lap cover portion 30 which, because it extends over a significant portion of the outer periphery OP, the outer edge cover portion 32' has been subdivided into a plurality of segments 32*s* by radial slits 44. The radial slits 44 provide for articulation of the segments 32*s* so that the outer lap cover portion 30 can bendably accommodate a larger or a smaller outside diameter coil.

Referring now to FIGS. 1, 2, 3 and 6 the structure and function of the inner lap protector 12 will be detailed.

The inner lap protector 12 has a generally "L" shape structure similar to that described with respect to the outer lap protector 10, but having an inner lap cover portion 46 curved to follow the curvature of the inside periphery IP of the coil 14 as defined by the inner lap 16, and an inner edge cover portion 48 that is integrally connected with the inner lap cover portion 46 along a curved right angle corner $C_2$. The inner lap cover portion 46 is preferred to be curved to match the curvature of the inner periphery of an average size coil, in this case the inner lap protector 10 can accommodate coils of various inside diameters both larger and smaller than this average diameter. The inner lap cover portion 46 has an inside surface 46*a* facing toward the coil 14 and an outside surface 46*b* facing away from the coil. The inner edge cover portion 48 has an inside surface 48*a* facing toward the coil and an outside surface 48*b* facing away from the coil. As in the outer lap portector 10, the inner lap cover portion 46 of the inner lap protector 12 includes a magnet 34' structured, attached and functioning in the same manner as discussed hereinabove with respect to the outer lap cover portion 30. It is preferred for a central displaced panel portion 50 of the inner edge cover protector 48 to be displaced in the manner of the displaced panel portion 36 discussed hereinabove. That is, the outside surface 50*b* of the central displaced panel portion 50 is displaced from the outside surface 48*b* and the inside surface 50*a* of the central displaced panel portion is displaced from the inside surface 48*a* in order to provide a spacing S for serving the same function as the displaced panel portion 36. An inner lap edge displaced panel portion (analogous to the outer lap edge displaced panel portion 38) may be provided.

Operation of the inner lap protector 12 is analogous to the described hereinabove with respect to the outer lap protector 10.

Figure 8:
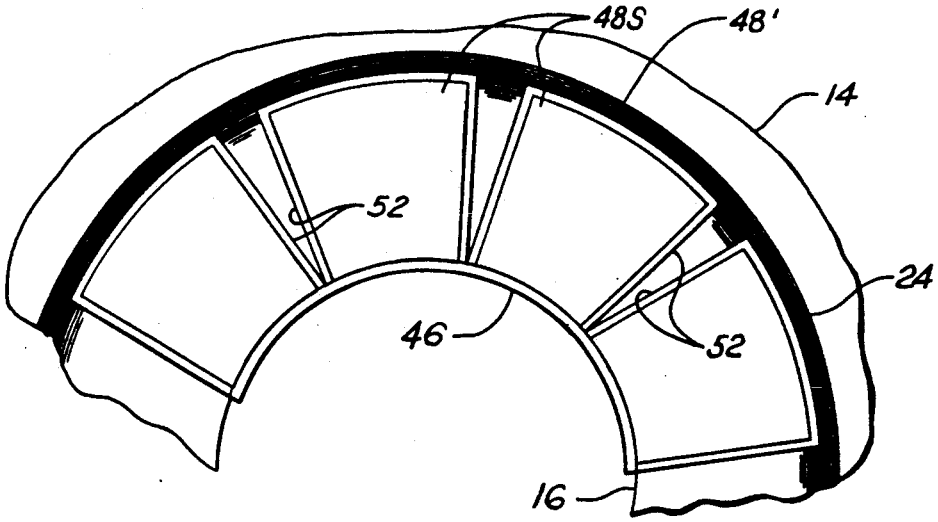
FIG. 8 is a side view of a segmentally articulated inner lap protector for accommodating coils of various outside diameters.

With respect to fitting the inner lap protector 12 upon coils of various inside diameters, as in the case of the outer lap protector 10, the inner lap protector may include relief slits 42 adjacent the ends of the curved corner $C_2$, and further may include, as shown in FIG. 8, an articulated inner edge cover portion 48' composed of segments 48*s* mutually separated by radial slits 52.

Figure 9:
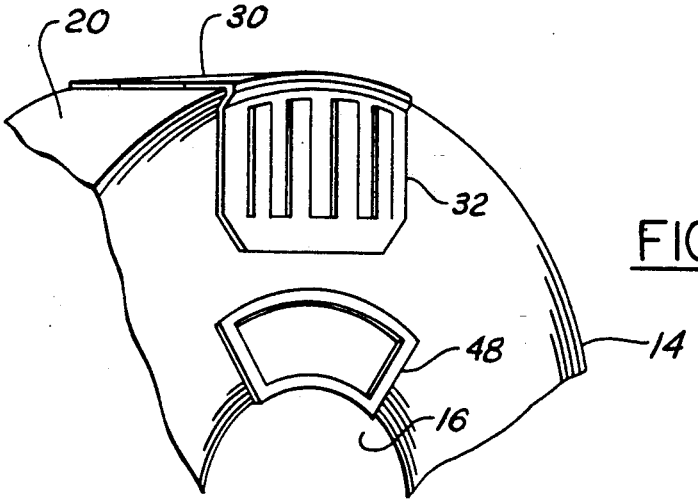
FIG. 9 is a perspective view of an outer lap protector and an inner lap protector each having expanded outer and inner edge cover portions.
Figure 11:
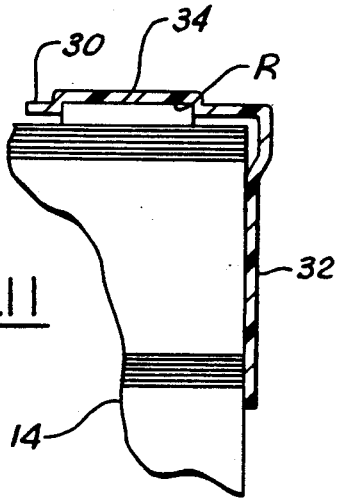
FIG. 11 is a sectional edge view of an outer lap protector having the magnet embedded into the outer lap cover portion.
Figure 10:
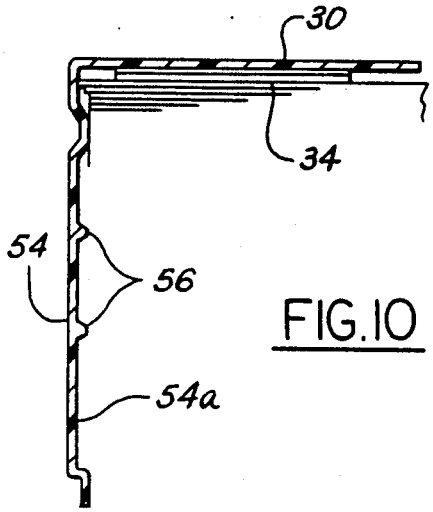
FIG. 10 is a sectional edge view of an outer lap protector having an alternatively shaped outer edge cover portion.

FIGS. 9 through 11 show variations of the invention. FIG. 9 depicts that the outer edge cover portion 32 and the inner edge cover portion 48 may extend radially from respective curved corners $C_1$ and $C_2$ in order that more of the lap edges 24 are protectively covered. FIG. 10 depicts a variation on the displaced panel portion 36 of the outer edge cover portion 32. Here, a central displaced panel portion 54 is provided structured similarly to the central displaced panel portion 50 of the inner edge cover portion 48. Stand-offs 56 are connected with the inside surface 54*a* of the central displaced panel portion 54 in order to provide spacing strength. Clearly, many variations in the displaced panel portions is possible, which in each case a surface is provided that is displaced from the coil for accommodating deformation caused by external forces without injury being inflicted thereby to the coil. Finally, FIG. 11 depicts a variation in the attachment of the magnet 34, 34' to respective outer and inner lap cover portions 30, 46. In this variation, the magnet is placed in the injection mold and embedded within a recess R, formed respectively in the outer lap cover portion and the inner lap cover portion, with or without adhesive.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A protector for a coil of ferrous sheet having a left and a right side, the coil being formed of a plurality of laps of the ferrous sheet, each lap having a lap edge on each of the left and right sides of the coil, the coil having an outer lap defining an outer periphery, the outer lap having an outer lap edge on each of the left and right sides of the coil, said protector comprising:

an outer lap cover portion having a curvature substantially matching that of the outer periphery of the coil, said outer lap cover having an inside surface for facing toward the coil and an outside surface for facing away from the coil;

a magnet attached to said inside surface of said outer lap cover portion, said magnet comprising a flexible sheet of magnetic material;

magnet attaching means for attaching said magnet to said inside surface of said outer lap cover portion, said magnet attaching means being unaffected by oil; and an outer edge cover portion integrally connected with said outer lap cover portion, said outer edge cover portion being oriented at a right angle with respect to said outer lap cover portion, said right angle being defined by a curved corner, said outer edge cover portion having an inside surface for facing toward the coil and an outside surface for facing away from the coil;

wherein said outer lap portion is placed upon the outer lap of the coil so that said magnet is magnetically attracted to the coil, said curved corner being located adjacent an outer lap edge of a selected one of said left and right sides of said coil, said outer lap cover portion covering a predetermined portion of the outer periphery of the outer lap, said outer edge cover portion covering a predetermined number of lap edges adjacent the outer lap edge of the selected side of the coil.

2. The protector of claim 1, further comprising displaced panel portion means connected with said outer edge cover portion for displacing a selected portion of said inner and outer surfaces of said outer edge cover portion from the predetermined number of lap edges covered by said outer edge cover portion.

3. The protector of claim 2, wherein said curved corner has a first end and a second end, wherein a first slit is provided in said curved corner from said first end thereof to a first predetermined location, wherein further a second slit is provided in said curved corner from said second end thereof to a second predetermined location, said first predetermined location being separated from said second predetermined location.

4. The protector of claim 2, wherein said outer edge cover portion comprises a plurality of segments each mutually separated by a radial slit.

5. The protector of claim 2, wherein said magnet attachment means comprises molding said magnet embedably into said outer lap cover portion.

6. The protector of claim 2, further comprising outer lap edge displaced panel portion means on said outer edge cover portion adjacent said curved corner for accommodating misalignment of said outer lap edge with adjacent lap edges.

7. A protector for a coil of ferrous sheet having a left side and a right side, the coil being formed of a plurality of laps of the ferrous sheet, each lap having a lap edge on each of the left and right sides of the coil, the coil having an inner lap defining an inner periphery, the inner lap having an inner lap edge on each of the left and right sides of the coil, said protector comprising:

an inner lap cover portion having a curvature substantially matching that of the inner periphery of the coil, said inner lap cover having an inside surface for facing toward the coil and an outside surface for facing away from the coil;

a magnet attached to said inside surface of said inner lap cover portion, said magnet comprising a flexible sheet of magnetic material;

magnet attaching means for attaching said magnet to said inside surface of said inner lap cover portion, said magnet attaching means being unaffected by oil; and an inner edge cover portion integrally connected with said inner lap cover portion, said inner edge cover portion being oriented at a right angle with respect to said inner lap cover portion, said right angle being defined by a curved corner, said inner edge cover portion having an inside surface for facing toward the coil and an outside surface for facing away from the coil;

wherein said inner lap portion is placed upon the inner lap of the coil so that said magnet is magnetically attracted to the coil, said curved corner being located adjacent the inner lap edge of a selected one of said left and right sides of the coil, said inner lap cover portion covering a predetermined portion of the inner periphery of the inner lap, said inner edge cover portion covering a predetermined number of lap edges adjacent the inner lap edge of the selected side of the coil.

8. The protector of claim 7, further comprising displaced panel portion means connected with said inner edge cover portion for displacing a selected portion of said inner and outer surfaces of said inner edge cover portion from the predetermined number of lap edges covered by said inner edge cover portion.

9. The protector of claim 8, wherein said curved corner has a first end and a second end, wherein a first slit is provided in said curved corner from said first end thereof to a first predetermined location, wherein further a second slit is provided in said curved corner from said second end thereof to a second predetermined location, said first predetermined location being separated from said second predetermined location.

10. The protector of claim 8, wherein said inner edge cover portion comprises a plurality of segments each mutually separated by a radial slit.

11. The protector of claim 8, wherein said magnet attachment means comprises molding said magnet embedably into said inner lap cover portion.

12. A protector system for a coil of ferrous sheet having a left side and a right side, the coil being formed of a plurality of laps of the ferrous sheet, each lap having a lap edge on each of the left and right sides of the coil, the coil having an outer lap defining an outer periphery, the outer lap having an outer lap edge on each of the left and right sides of the coil, the coil further having an inner lap defining an inner periphery, the inner lap having an inner lap edge on each of the left and right sides of the coil, said protector system comprising:

an outer lap protector, comprising:

an outer lap cover portion having a curvature substantially matching that of the outer periphery of the coil, said outer lap cover portion having an inside surface for facing toward the coil and an outside surface for facing away from the coil;

a first magnet attached to said inside surface of said outer lap cover, said first magnet comprising a flexible sheet of magnetic material;

first magnet attaching means for attaching said first magnet to said inside surface of said outer lap cover portion, said magnet attaching means being unaffected by oil; and an outer edge cover portion integrally connected with said outer lap cover portion, said outer edge cover portion being oriented at a right angle with respect to said outer lap cover portion, said right angle being defined by a first curved corner, said outer edge cover portion having an inside surface for facing toward the coil and an outside surface for facing away from the coil;

wherein said outer lap portion is placed upon the outer lap of the coil so that said first magnet is magnetically attracted to the coil, said first curved corner being located adjacent an outer lap edge of a first selected one of the left and right sides of the coil, said outer lap cover portion covering a predetermined portion of the outer periphery of the outer lap, said outer edge cover portion covering a predetermined number of lap edges adjacent the outer lap edge of the first selected side of the coil; and an inner lap protector, comprising:

an inner lap cover portion having a curvature substantially matching that of the inner periphery of the coil, said inner lap cover having an inside surface for facing toward the coil and an outside surface for facing away from the coil;

a second magnet attached to said inside surface of said inner lap cover portion, said second magnet comprising a flexible sheet of magnetic material;

second magnet attaching means for attaching said second magnet to said inside surface of said inner lap cover portion, said second magnet attaching means being unaffected by oil; and an inner edge cover portion integrally connected with said inner lap cover portion, said inner edge cover portion being oriented at a right angle with respect to said inner lap cover portion, said right angle being defined by a curved corner, said inner edge cover portion having an inside surface for facing toward the coil and an outside surface for facing away from the coil;

wherein said inner lap portion is placed upon the inner lap of the coil so that said second magnet is magnetically attracted to the coil, said curved corner being located adjacent an inner lap edge of a second selected one of the left and right sides of the coil, said inner lap cover portion covering a predetermined portion of the inner periphery of the inner lap, said inner edge cover portion covering a predetermined number of lap edges adjacent the inner lap edge of the second selected one of the sides of the coil.

13. The protector system of claim 12, further comprising:

first displaced panel portion means connected with said outer edge cover portion for displacing a selected portion of said inner and outer surfaces of said outer edge cover portion from the predetermined number of lap edges covered by said outer edge cover portion; and second displaced panel portion means connected with said inner edge cover portion for separating a selected portion of said inner and outer surfaces of said inner edge cover portion from the predetermined number of lap edges covered by said inner edge cover portion.

14. The protector system of claim 13, wherein said first curved corner has a first end and a second end, wherein a first slit is provided in said first curved corner from said first end thereof to a first predetermined location, wherein further a second slit is provided in said first curved corner from said second end thereof to a second predetermined location, said first predetermined location being separated from said second predetermined location; further wherein said second curved corner has a first end and a second end, wherein a first slit is provided in said second curved corner from said first end thereof to a third predetermined location, wherein further a second slit is provided in said second curved corner from said second end thereof to a fourth predetermined location, said third predetermined location being separated from said fourth predetermined location.

15. The protector system of claim 13, wherein said outer edge cover portion comprises a plurality of first segments each mutually separated by a first radial slit; further wherein said inner edge cover portion comprises a plurality of second segments each mutually separated by a second radial slit.

16. The protector system of claim 15, wherein said first and second magnet attachment means comprises molding said first magnet embedably into said outer lap cover portion and molding said second magnet embedably into said inner lap cover portion.

17. The protector system of claim 15, further comprising outer lap edge displaced panel portion means on said outer edge cover portion adjacent said first curved corner for accommodating misalignment of said outer lap edge with adjacent lap edges.

* * * * *